US006406018B1

(12) United States Patent
Swaile

(10) Patent No.: US 6,406,018 B1
(45) Date of Patent: Jun. 18, 2002

(54) GAME APPARATUS

(76) Inventor: Edmund Neil Swaile, 41 Tufnell Way, Colchester Essex $CO_{4\ 5}$ AP (GB)

( * ) Notice: Subject to any disclaimer, the term of this patent is extended or adjusted under 35 U.S.C. 154(b) by 0 days.

(21) Appl. No.: 09/831,317

(22) PCT Filed: Nov. 9, 1999

(86) PCT No.: PCT/GB99/03697

§ 371 (c)(1),
(2), (4) Date: May 7, 2001

(87) PCT Pub. No.: WO00/27492

PCT Pub. Date: May 18, 2000

(30) Foreign Application Priority Data

Nov. 9, 1998 (GB) ..... 9824487

(51) Int. Cl.[7] ..... A63F 7/04
(52) U.S. Cl. ..... 273/118 R; 273/118 A
(58) Field of Search ..... 273/440, 447, 273/448, 456, 108, 118 R, 123 R

(56) References Cited

U.S. PATENT DOCUMENTS 4,066,263 A * 1/1978 Balas et al. ..... 273/120 R
4,067,576 A * 1/1978 Balas et al. ..... 273/120 R
4,077,036 A * 2/1978 Avakian et al. ..... 200/1 R
4,118,026 A * 10/1978 Todokoro ..... 273/412
5,536,007 A * 7/1996 Snyder ..... 119/702
5,657,995 A * 8/1997 Howard ..... 273/333

* cited by examiner

*Primary Examiner*—Raleigh W. Chiu
(74) *Attorney, Agent, or Firm*—Renner, Kenner, Greive, Bobak, Taylor & Weber

(57) ABSTRACT

A game apparatus which comprises an upper surface and a lower surface which together define an intermediate chamber. The upper surface has a plurality of apertures each of which is provided with a closure device such as a pair of shutters, a sliding door, or a hinged lid. Movement of the apparatus randomly positions a ball within the chamber at one of a number of locations on the lower surface of the apparatus. A retrieval device is inserted through a selected aperture and if the ball is beneath that aperture the retrieval device magnetically connects thereto and permits the removal of the ball from the intermediate chamber.

15 Claims, 6 Drawing Sheets

GAME APPARATUS

This invention relates to game apparatus permitting the retrieval of a ball from a random location within a location-concealing chamber.

Various designs of game apparatus are known, having a random nature. For example, U.S. Pat. No. 5,536,007 describes a cat toy having a ball located behind a screen with holes formed therethrough. The intention is that a cat may play with the toy, watching the ball through the holes, but there is no arrangement for retrieving the ball through the holes. In addition, U.S. Pat. No. 4,630,822 describes a game where a number of ball are randomly knocked into discrete apertures in a dish-shaped playing surface by a spinning top. The balls may be recovered from the various value apertures by a collecting device.

According to the present invention, there is provided a game apparatus comprising: a lower surface; an upper surface over lying the lower surface and spaced therefrom so as to define a concealment chamber intermediate the upper and lower surfaces, the upper surface having a plurality of apertures each of which is provided with a closure means; a ball for positioning at a random location on the lower surface and being concealed within the concealment chamber; and a retrieval device connectable to the ball and which may be used to attempt retrieval of the ball from within the concealment chamber by inserting the retrieval device through a selected one of the plurality of apertures.

It will be appreciated that the ball may be disposed at a random location on the lower surface simply by shaking the apparatus and then the retrieval device is used to attempt to extract the ball from the chamber, by inserting that device into a randomly selected opening. Depending upon the configuration of the closure, it may be necessary to open that closure before inserting the device or the device may be inserted through the closure—but in either case, the design of the closure should be such that the location of the ball cannot be determined visually, from an external viewpoint.

The apparatus may be associated with a game-playing board carrying appropriate markings and in that case the ball, once retrieved from the apparatus, may be employed in further game play, on that board. In this case, the apparatus may be configured so as to be connectable to and easily removable from the game-playing board.

Preferably the ball is made from a ferro-magnetic material such as steel, and the retrieval device has a magnetic end for releasable connection to the ball. Such a retrieval device is conveniently rod shaped.

Whilst the apparatus could be used separately from a game board, the apparatus may advantageously be placed on a board and the board moved from side to side by the players. These movements enable a ball placed within the apparatus to roll to an unknown random location within the chamber. The retrieval of the ball from its concealed position can then be attempted by the insertion of the retrieval device through a randomly-selected aperture in the upper surface. The apparatus thus allows the players in a game the opportunity of locating and retrieving a ball, by chance.

It is desirable that the lower surface defines a number of specific ball locating positions, such that in use the ball will normally remain in one position, but if sufficient force is applied to the device, the ball will be dislodged from this one position and move within the intermediate concealment chamber, randomly to relocate at any one of the ball locating positions. For example, the specific ball locating positions may take the form of peaks and troughs or recesses provided on the lower surface, each such ball locating position being disposed directly beneath an aperture in the upper surface.

The closure may take any of a number of forms, but preferably each closure comprises a pair of shutters hingedly connected to the upper surface, and movable between respective closed positions where they are parallel to the upper surface and cover the aperture and open positions where they permit the removal of a concealed ball. Alternatively, each closure may comprise a removable block that covers the aperture but is completely removable therefrom to permit an attempt at removal of a concealed ball.

It is preferred that the closure should conceal the location of a ball, whilst permitting the entry of the retrieval device and removal of the ball with the least amount of actions. To this end a closure that allows entry of the ball retrieval device through a hole therein and then removal of the ball without any separate opening or closing action is preferred.

Such a hole should be suitably sized to permit the passage of the retrieval device therethrough but prevent a concealed ball from being visible from outside the device. Therefore, an attempt at removal of the bail is a simple one-handed task wherein the retrieval device is inserted through the chosen hole without hindrance from the closure; if the ball is present beneath the aperture the retrieval device makes contact with the ball to permit its removal. This is achieved by pulling the retrieval device out of the aperture, the passage of the ball through the aperture serving to open the closure.

In the alternative, a closure that is not openable automatically by the retrieval device or the ball may be employed. For example, each closure may comprise a single lid hingedly connected to the upper surface and movable between a closed position covering the aperture and an open position where entry of the retrieval device and removal of a ball is permitted. Alternatively, each closure may comprise a sliding door connected to the upper surface and movable between open and closed positions. To facilitate the movement of such a sliding door, runners may be arranged on the upper surface of the device, for guiding and retaining all of the doors.

As the ball is likely to be removed during game play, a side wall of the apparatus is preferably provided with an access hatch having an openable cover, to permit the reintroduction of the ball into the intermediate chamber. In addition, the game apparatus is preferably provided with a recess on the underside of the lower surface to allow the apparatus to be positioned and secured on a game board.

In use, the apparatus is shaken randomly to position the ball within the intermediate chamber. A retrieval device is inserted through an aperture in the upper surface, either after opening the associated closure or through the closure, depending on the type of closure used. If the ball, or one of a number of balls, contained within the chamber is found beneath the aperture, the retrieval device connects to the ball and removal of the retrieval device extracts the ball from the chamber.

By way of example only, various specific embodiments of the present invention will now be described in detail, with reference to the accompanying drawings in which.

Figure 1:
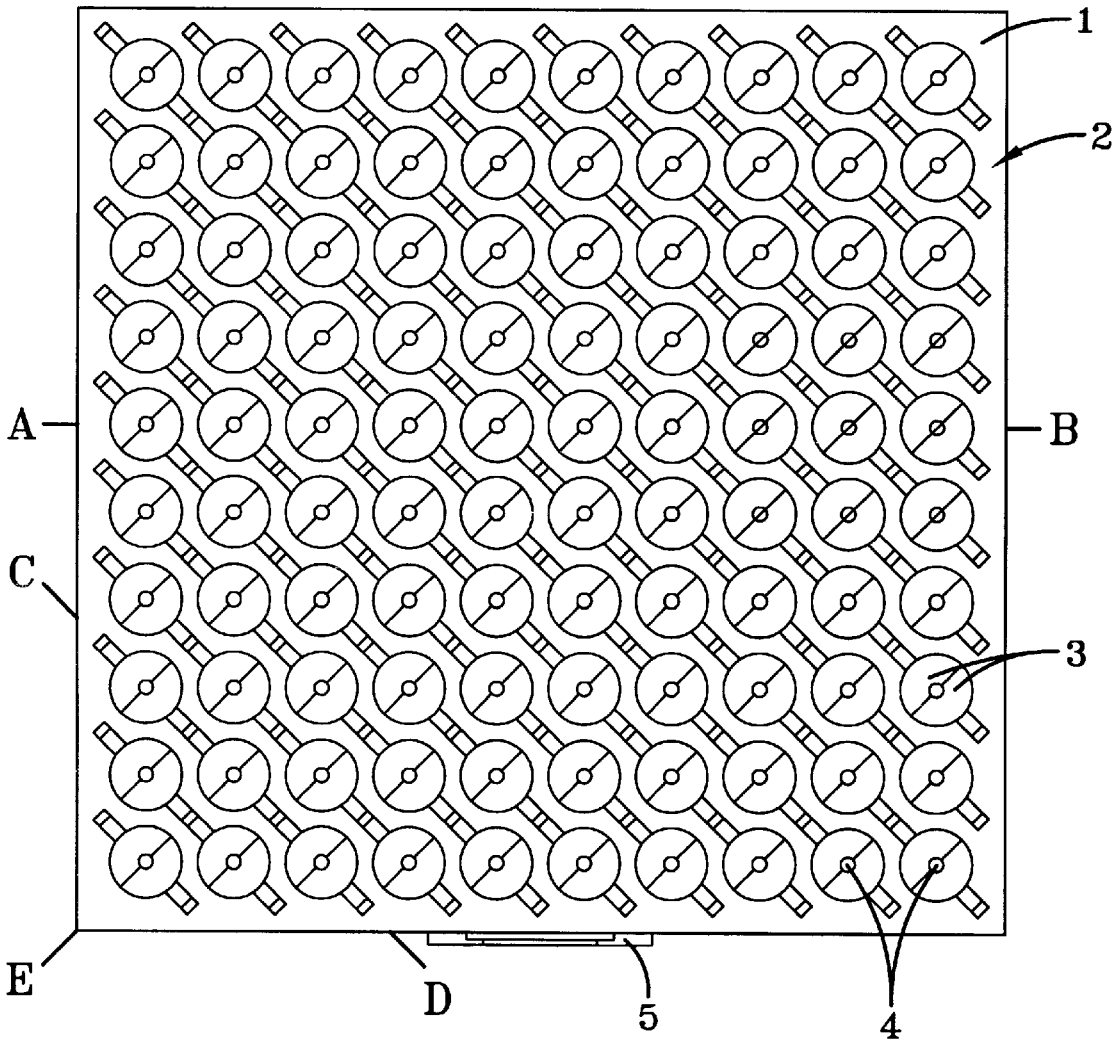
FIG. 1 is a plan view on the upper surface of the first embodiment of the apparatus.

Referring initially to FIG. 1, the upper surface 1 of a game apparatus is shown. Disposed over the upper surface 1 is a matrix of apertures generally indicated 2 and which permit access to an intermediate chamber (not shown in FIG. 1) defined beneath the upper surface 1. Each aperture is provided with a closure in the form of a pair of shutters 3. Each shutter 3 is hingedly connected to the upper surface 1 for movement between a closed position lying in the plane of the surface 1 (as shown in the drawing) to an open position where it does not overlie the associate aperture. Each pair of shutters 3 defines a small hole 4 between their adjacent edges. These holes allow the entry of a retrieval device (not shown) into the intermediate chamber without requiring the opening of the shutters before insertion of the retrieval device.

Figure 2:
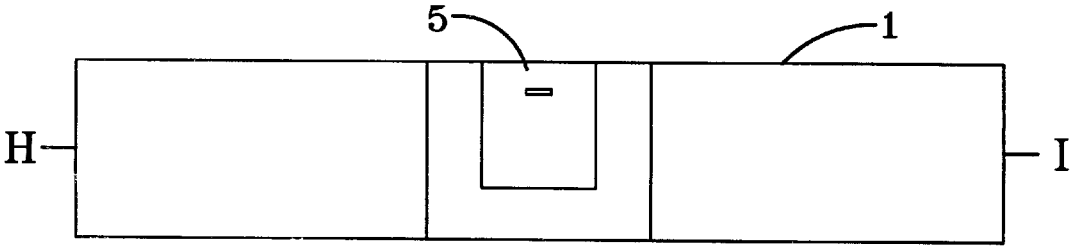
FIG. 2 is a side view of the embodiment of FIG. 1.

A side of the apparatus is shown in FIG. 2, and a covered access hatch 5 can be seen. This access hatch may be opened to permit the removal or introduction of an object into the intermediate chamber of the apparatus.

Figure 3:
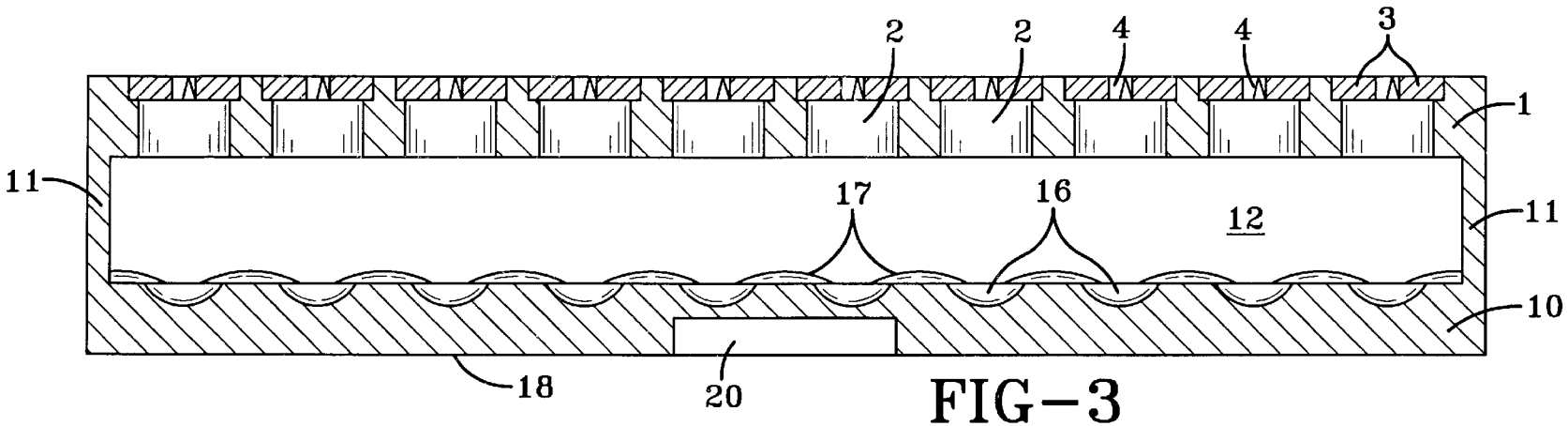
FIG. 3 is an enlarged section on line A–B, marked on FIG. 1.

FIG. 3 shows a section through the embodiment of FIG. 1. An upper surface 1 and a lower surface 10 are shown, the upper surface being supported on sides 11 that extend up from the lower surface 10. The upper surface, lower surface and sides together define an intermediate chamber 12. Each aperture 2 in the upper surface is provided with a respective closure in the form of two shutters 3. Each aperture 2 is located above a ball locating position in the form of a circular recess or trough 16 in the lower surface 10. Circular peaks 17 are also provided on the lower surface 10 at points between the troughs 16 so that a ball (not shown) introduced into the intermediate chamber 12 will be urged to locate under gravity in one of the ball locating positions. The underside 18 of the lower surface 10 is provided with a recess 20 which is used to locate and removably connect the apparatus to a game board.

Figure 4:
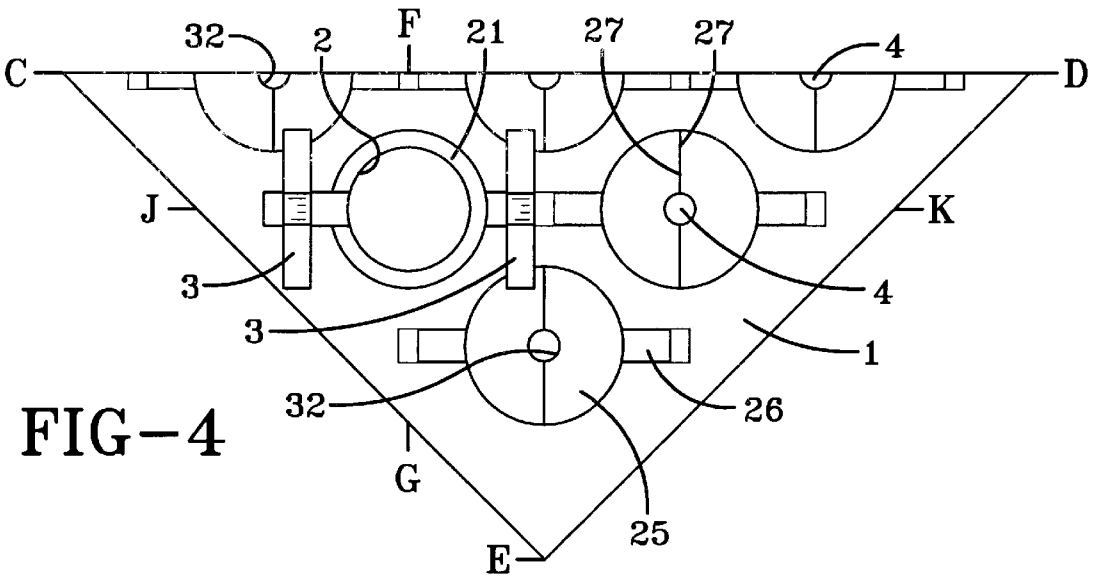
FIG. 4 is an enlargement of the corner area marked C, D, E on FIG.1, with one pair of shutters open.

An enlarged view of a section of the upper surface is shown in FIG. 4. In this drawing the shutters 3 of one pair are shown in their open position revealing an aperture 2. A ledge 21 is provided around the edge of the aperture to support the shutters 3 in their closed position. Each shutter 3 comprises a substantially semicircular portion 25 that overlies approximately half of an aperture 2, which semi-circular portion 25 is attached to a rectangular extension 26. The outer end of the extension 26 is hinged to the upper surface 1 at a point radially displaced outwardly from the generally circular aperture 2. The positioning of this pivot point for the hinge allows the shutter 3 to move to an open position whereat the aperture is not obstructed by the shutter.

When both shutters of a pair are in their closed positions, the semi-circular portions 25 rest on the ledge 21 and cover the majority of the aperture 2. When the shutters are in the closed position the adjacent edges 27 thereof define a hole 4, formed by semicircular cut-outs 32 in the edges 27.

Figure 5:
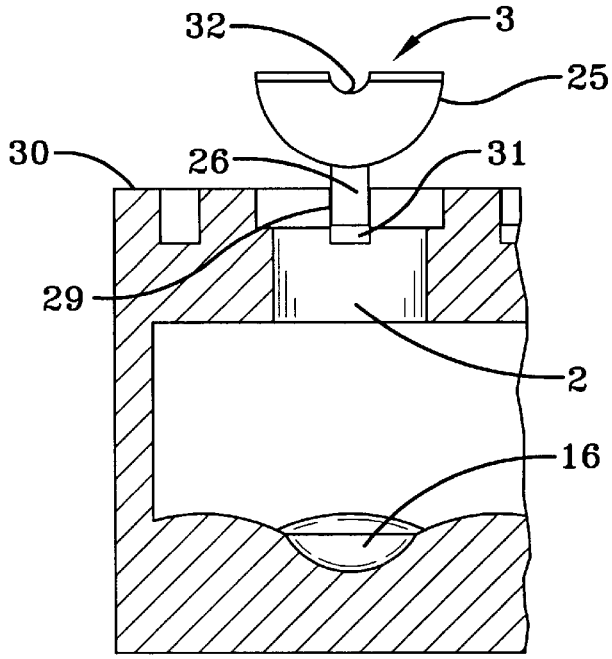
FIG. 5 is a section on line F–G on FIG. 4, showing a shutter in an open position.

FIG. 5 shows a partial vertical section through the apparatus, with a shutter 3 standing in its open position. As mentioned above, the shutter comprises a semi-circular portion 25 having an extension 26, there being a hinge 29 on the extension 26 connected to the upper surface 1. When in its closed position, the shutter 3 lies flush with the top face 30 of the upper surface 1. The extension 26 is located in a channel 31 which is sufficiently deep to permit the movement of the extension (and the remainder of the shutter) between the open and closed positions. This Figure also illustrates a cut-out 32.

Figure 6:
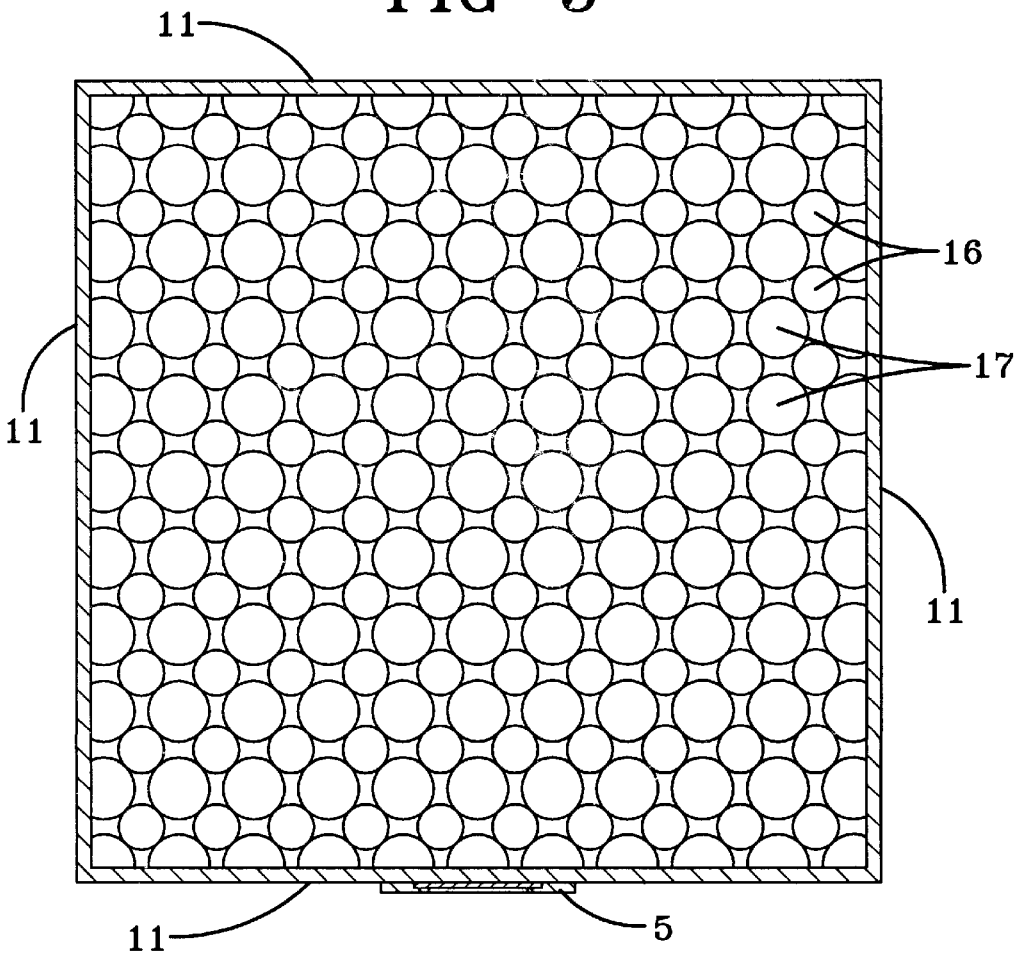
FIG. 6 is a section on line H–I on FIG. 2, and illustrates the arrangement of peaks and troughs on the lower surface.

FIG. 6 is a horizontal section through the apparatus, showing the lower surface 10. Circular troughs 16 are arranged on the lower surface for locating a ball (not shown), and peaks 17 are arranged between the troughs 16. The arrangement ensures that a ball will always roll into a trough so as to be disposed beneath an aperture in the upper surface. When the ball is to be randomly repositioned, shaking of the apparatus from side to side will dislodge the ball from one of the troughs and cause it to move within the intermediate chamber. When the shaking stops, the ball move under gravity to locate in the nearest trough.

Figure 7:
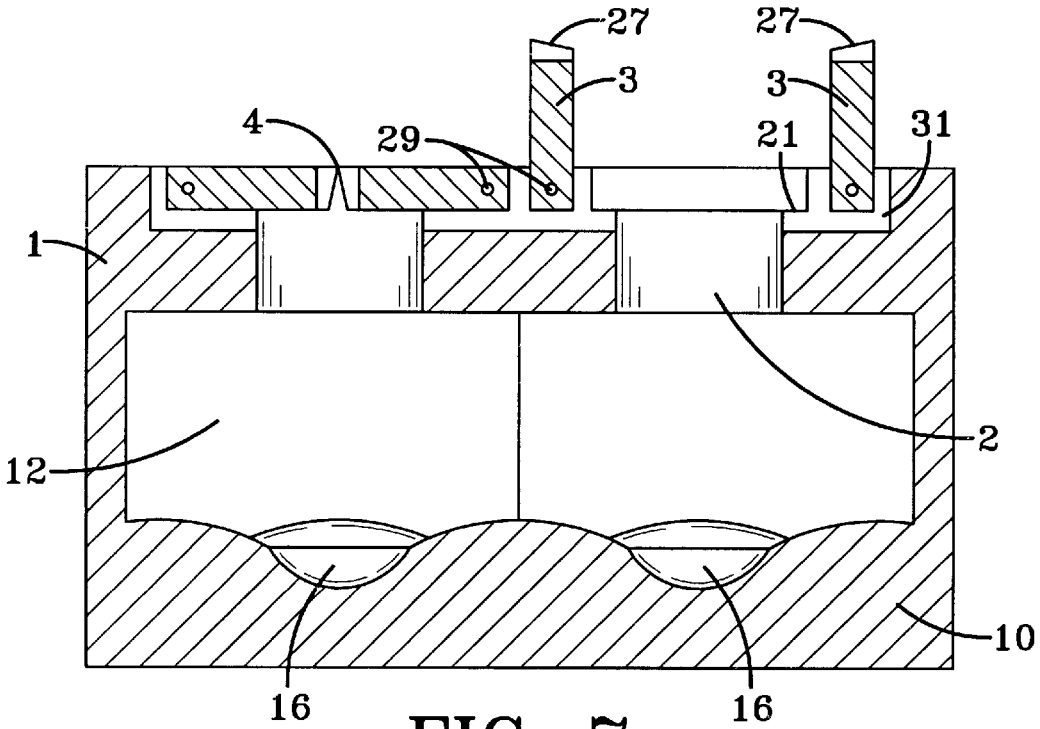
FIG. 7 is a section on line J–K on FIG. 4, with one pair of shutters open and another pair closed.

FIG. 7 is a section through the apparatus on line J–K on FIG. 4. Two ball locating troughs 16 are formed on the lower surface 10 and are positioned beneath two apertures 2 in the upper surface 1. Each aperture 2 has a closure comprising a pair of shutters 3. The aperture on the left is shown with both shutters 3 in the closed position, and the aperture on the right is shown with both shutters 3 in the open position. The faces of the shutters at the adjacent edges 27 of the shutters 3 are angled so that they can hinge into close alignment.

Figure 8:
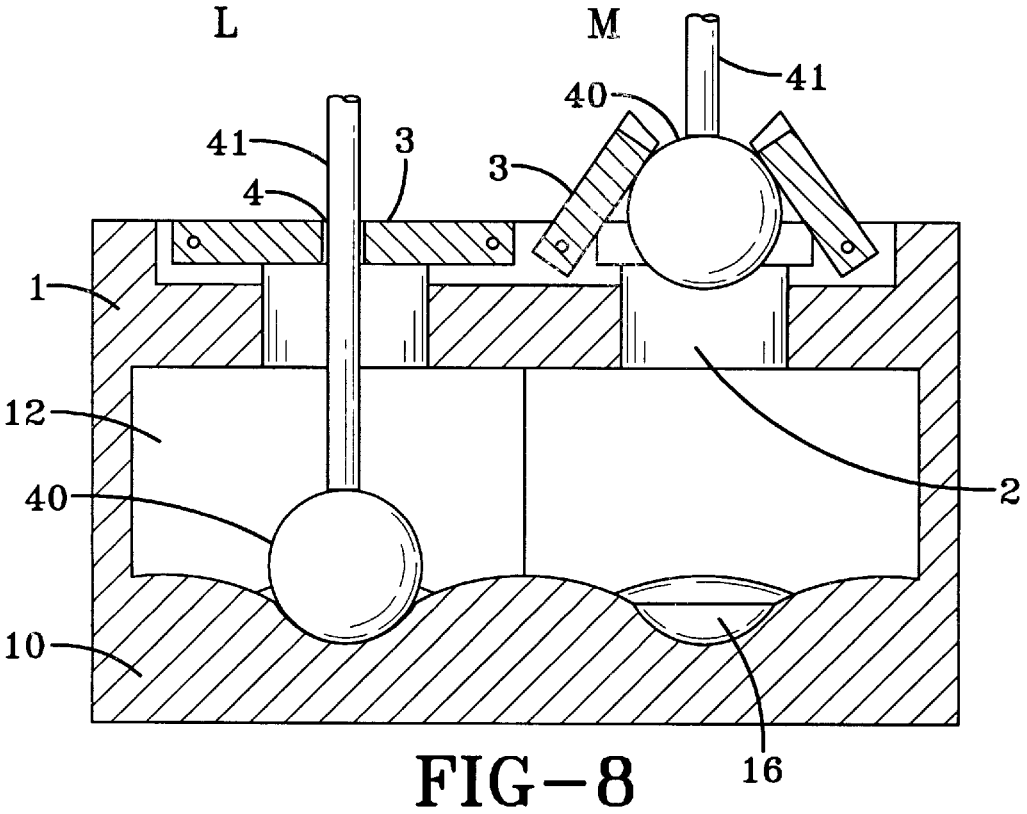
FIG. 8 is a view similar to FIG. 7 but now showing two balls and retrieval devices.

FIG. 8 is similar to FIG. 7 but now illustrates the removal of a metal ball 40 located in the intermediate chamber 12. The left hand side of the Figure shows the ball 40 resting in a trough 16, and a rod-shaped retrieval device 41 inserted through the hole 4 between the shutters. The insertion of the retrieval device does not require the opening of the shutters. The retrieval device 41 is magnetised to allow it to connect to the metal ball 40. Once the connection has been established, the retrieval device 41 and the ball 40 are retracted as shown on the right hand side of FIG. 8. As the ball 40 has a diameter larger than the hole 4, the ball engages the underside of the shutters 3 and moves them to their open position, as the ball exits the aperture 2.

The ball contained within the intermediate chamber needs to be of a ferro-magnetic material for connecting to a magnetic retrieval device. However, various other retrieval devices could be employed, in which case the ball would need to be suitably designed to co-act therewith. When holes 4 are provided in the closure to permit entry of the retrieval device, it is important that the ball may not easily be seen from outside the device. To achieve this, the holes and retrieval device are made as small as is reasonably possible. Furthermore the ball may be blackened to prevent reflections from it revealing its location.

Figure 9:
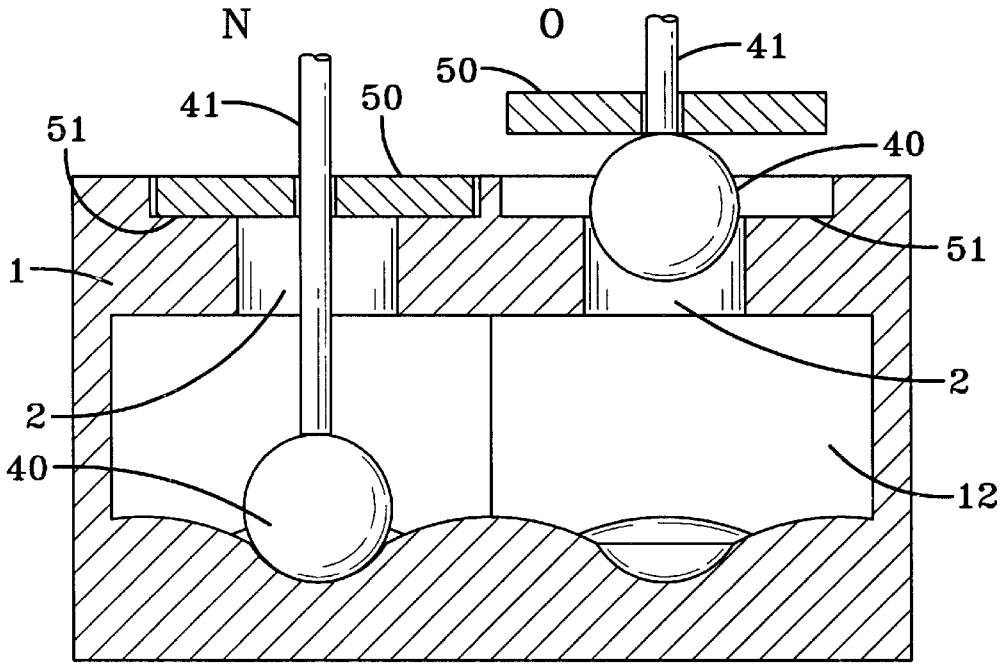
FIG. 9 is a view similar to FIG. 8 but of a different embodiment in which the closure is a block.

FIG. 9 shows a modified form of the apparatus, as compared to that of FIG. 8. In this embodiment like parts with those of the previous embodiment are given like reference numerals. In FIG. 8, instead of shutters, the closures comprise blocks 50 with small holes in their centres, which blocks rest upon ledges 51 formed around the apertures in the upper surface 1. When a retrieval device 41 is inserted into the intermediate chamber 12 through the hole in the block 50 it may make contact and connect with the ball 40. Retraction of the retrieval device when a ball is connected thereto will lift both the ball and the block 50 from the aperture 2.

Figure 10:
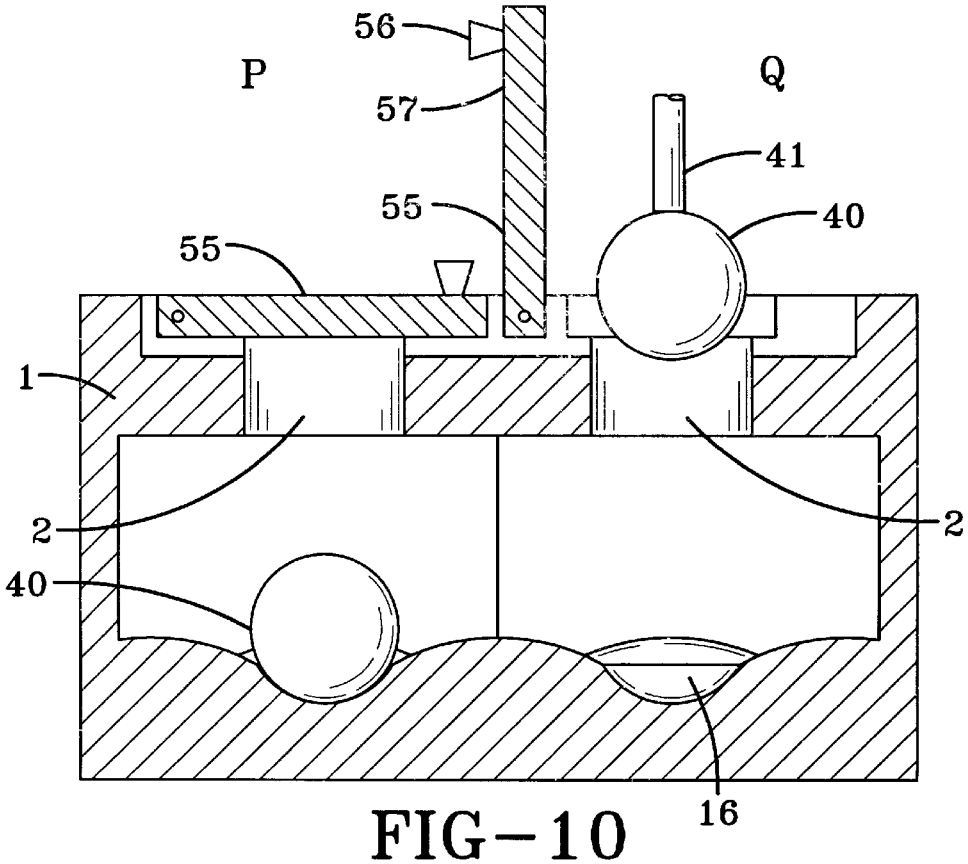
FIG. 10 is a similar section to that of FIGS. 8 and 9 but of a third embodiment in which the closure is a hinged lid.

Referring now to FIG. 10, a third embodiment is shown, similar to both FIG. 8 and FIG. 9, and again like reference numerals are used for like parts. Instead of shutters or blocks as in the first two embodiments, a series of hinged lids 55 which may pivot open are incorporated into the upper surface 1. Before a retrieval device 41 can be inserted into the chamber in an attempt to retrieve the ball 40, the lid 55 above the opening 2 must be opened. To facilitate the manual opening of the lid 55, a knob 56 is provided oh its top face 57.

Figure 11:
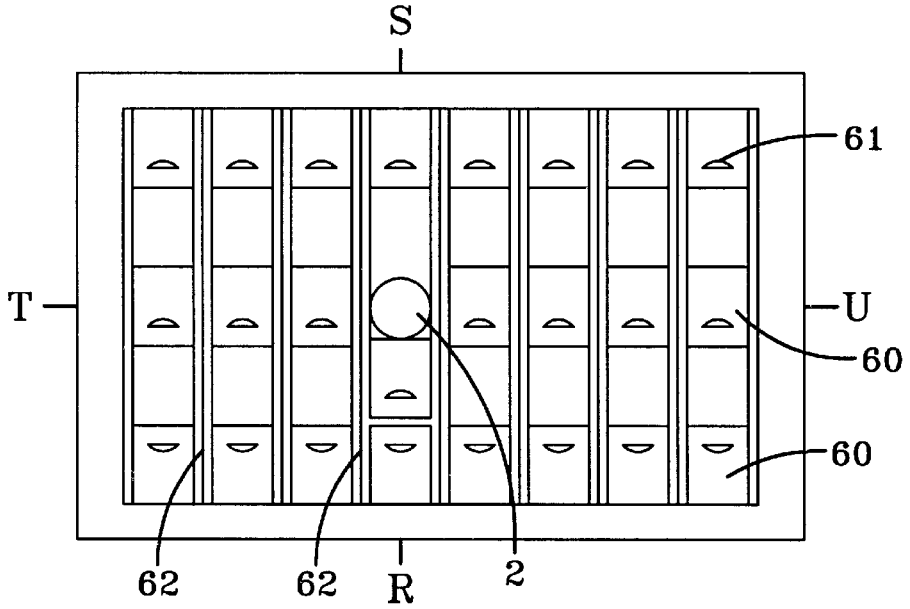
FIG. 11 is a plan view of a fourth embodiment of the apparatus.
Figure 12:
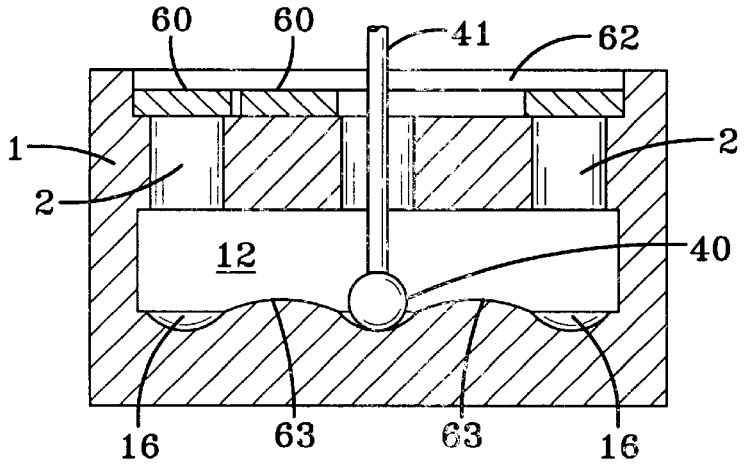
FIG. 12 is a section through line R–S on FIG. 11.
Figure 13:
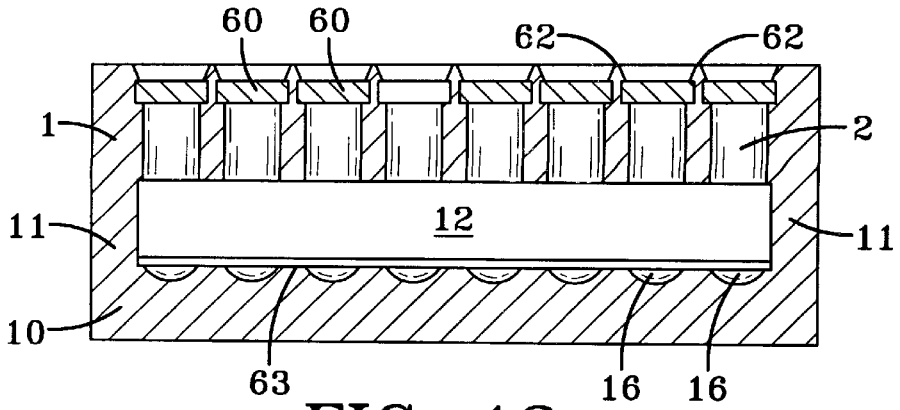
FIG. 13 is a section through line T–U on FIG. 11.

FIGS. 11, 12 and 13 show a fourth embodiment of game apparatus. This embodiment is similar to those described above but has different closures and the arrangement of the apertures peaks and troughs is different. For convenience, parts common with the previous embodiments are given like reference numerals. Each closure comprises a door 60 that can be slid between a closed position where it covers the associated aperture and an open position whereat the insertion of a retrieval device 41 is permitted. Each door 60 has a recess 61 to aid its movement by a finger of a player, and all the sliding doors are constrained for sliding movement by runners 62 arranged on the upper surface.

In this fourth embodiment, the peaks are formed as elongate ridges 63 rather than discrete areas. This is possible because in this embodiment the arrangement of the apertures 2 and consequently the ball locating positions is different. The large gaps between the lines of holes which are necessary to provide the space for sliding the doors mean that the ball locating positions are also more spread out in at least one direction. Consequently only two ridges 63 need be provided on the lower surface 5.

In all of the embodiments described above, the overall shape of the apparatus could take many forms e.g. round, triangular or irregularly shaped. The shape and number of shutters, blocks, lids or sliding doors could all take different forms with a corresponding variation in shape and number of apertures, peaks and troughs. Further, various types of closure could be used within a single embodiment. Also the small holes 4 in the centres of the pairs of shutters 3 and the blocks 50, although allowing the entry of a magnetic rod or other implement without the need to open the shutters or take out the blocks first, could be omitted, so necessitating the opening of the shutter before inserting the retrieval device.

What is claimed is:

1. Game apparatus comprising: a lower surface; and upper surface over lying the lower surface and spaced therefrom so as to define a concealment chamber intermediate the upper and lower surfaces, the upper surface having a plurality of apertures each of which is provided with a closure means; a ball for positioning at a random location on the lower surface and being concealed within the concealment chamber; and a retrieval device connectable to the ball and which may be used to attempt retrieval of the ball from within the concealment chamber by inserting the retrieval device through a selected one of the plurality of apertures.

2. Game apparatus as claimed in claim 1, wherein the ball is made from a ferro-magnetic material and the retrieval device is magnetised.

3. Game apparatus as claimed in claim 1, wherein the retrieval device is rod shaped.

4. Game apparatus as claimed in claim 1, wherein the lower surface defines a number of specific ball locating positions such that in use the ball will normally remain in one of said positions, but if sufficient force is applied to the apparatus, the ball will be dislodged from its position and move within the intermediate chamber randomly to relocate at either another of the positions or the one position.

5. Game apparatus as claimed in claim 4, wherein peaks and troughs are provided on the lower surface to define the specific positions for retaining the ball.

6. Game apparatus as claimed in claim 4, wherein each ball locating position lies directly beneath an aperture in the upper surface.

7. Game apparatus as claimed in claim 1, wherein each closure means comprises a pair of shutters hingedly connected to the upper surface, and moveable between respective closed positions where the shutters are generally parallel to the upper surface and cover the aperture therein and respective open positions where the shutters permit the removal of a concealed ball.

8. Game apparatus as claimed in claim 1, wherein each closure means comprises a removable block that covers the respective aperture but is movable away therefrom to permit removal of a concealed ball.

9. Game apparatus as claimed in claim 1, wherein each closure means comprises a single lid hingedly connected to the upper surface and movable between a closed position covering the opening and an open position where entry of the retrieval device and removal of the ball is permitted.

10. Game apparatus as claimed in claim 1, wherein each closure means comprises a sliding door connected to the upper surface and movable between a closed position covering the aperture and an open position where entry of the retrieval device and removal of the ball is permitted.

11. Game apparatus as claimed in claim 10, wherein runners are provided on the upper surface to guide and retain the sliding doors.

12. Game apparatus as claimed in claim 1, wherein each closure means is openable to permit the entry of the retrieval device and removal of the ball.

13. Game apparatus as claimed in claim 12, wherein the retrieval device is adapted to pass through a small hole defined in each closure means so that the retrieval device may be inserted into the concealment chamber without the closure means having first been opened, and wherein the hole is suitably sized to prevent a ball concealed within the chamber from being visible externally to a person playing with the game apparatus.

14. Game apparatus as claimed in claim 1, wherein an access hatch with a cover is provided on a side of the concealment chamber for the introduction of a ball thereinto or removal of a ball therefrom.

15. Game apparatus as claimed in claim 1, wherein a recess is provided on the underside of the lower surface to allow the apparatus to be positioned and secured on a game-playing board.

* * * * *